US005383755A

United States Patent [19]

Hässig et al.

[11] Patent Number: 5,383,755

[45] Date of Patent: Jan. 24, 1995

[54] APPARATUS IN A BOOK BINDING MACHINE FOR PRODUCING NOITCHES IN THE BACK OF A BOOK BLOCK

[75] Inventors: Fredy Hässig, Märstetten; Marcel Stolz, Felben, both of Switzerland

[73] Assignee: Grapha-Holding AG

[21] Appl. No.: 78,410

[22] Filed: Jun. 17, 1993

[30] Foreign Application Priority Data

Jun. 19, 1992 [CH] Switzerland ..... 01954/92

[51] Int. Cl.[6] ..... B42C 5/04

[52] U.S. Cl. ..... 412/16; 83/455; 83/594; 83/875; 83/934

[58] Field of Search ..... 412/16, 18, 32; 83/332, 83/455, 483, 668, 671, 692, 594, 875, 821, 917, 934; 409/138, 201, 205

[56] References Cited

U.S. PATENT DOCUMENTS

| | | | |
|---|---|---|---|
| 1,642,866 | 9/1927 | Ackley | 412/16 |
| 1,980,267 | 11/1934 | Gould et al. | 412/16 |
| 2,565,583 | 8/1951 | Ackley et al. . | |
| 3,758,928 | 9/1973 | Blake . | |
| 4,741,236 | 5/1988 | Averill | 416/16 X |
| 4,993,292 | 2/1991 | Kunz | 83/917 X |

FOREIGN PATENT DOCUMENTS

| | | | |
|---|---|---|---|
| 563277 | 3/1957 | Italy | 83/671 |
| 1-301373 | 12/1989 | Japan | 412/16 |
| 1346217 | 2/1974 | United Kingdom . | |
| 2096945 | 10/1982 | United Kingdom . | |
| 1613322 | 12/1990 | U.S.S.R. | 83/934 |

*Primary Examiner*—Tom Hughes
*Attorney, Agent, or Firm*—Friedrich Kueffner

[57] ABSTRACT

An apparatus in a book binding machine for binding books by gluing includes a notch cutting tool for producing notches in the back of the book block, wherein the notches extend approximately transversely of the back of the book block. The notch cutting tool is mounted for cutting notches in a portion of the book block which projects from a mounting device. A rotatably mounted abutment has a cylindrical support surface for laterally supporting the projecting portion against the cutting force exerted by the notch cutting tool. A guide plate is mounted rearwardly offset from the cylindrical support surface of the abutment. The guide plate has a groove surrounding the travel path of the notch cutting tool and the cylindrical support surface of the abutment is located opposite the groove in the guide plate.

10 Claims, 1 Drawing Sheet

APPARATUS IN A BOOK BINDING MACHINE FOR PRODUCING NOITCHES IN THE BACK OF A BOOK BLOCK

BACKGROUND OF THE INVENTION

1. Field of the Invention

The present invention relates to an apparatus in a book binding machine for producing notches in the back of a book block, wherein the notches extend approximately transversely of the side edges or folded edges of the book block. The book block is mounted in such a way that the book block has a projecting portion. The apparatus includes a cutting tool for producing the notches and an abutment arranged above the cutting tool for laterally supporting the projecting portion of the book block against the cutting force.

2. Description of the Related Art

For improving the stability and durability of a book, prior to gluing the back of the book block, an increase of the sheet edge surface is effected by producing notches extending approximately transversely of the side edges or folded edges. This procedure requires the application of high forces and causes substantial strain on the book binding plant.

When the support of the projecting portion of the book block is unstable, the accuracy to size is insufficient and results in a reduction of the quality of the product being produced.

Because of high frictional forces, stationary lateral support devices for the projecting portion of the book block used in the past resulted in harmful markings, such as scratch marks or undulations. In addition, the support device had to be readjusted or replaced after a certain time because of wear.

As is well known, when cutting the backs of book block by means of so-called circular knives, rotating pressing rollers are used as abutments on both sides of the projecting portion of the book block. Because of the approximately flush cutting plane, these pressing rollers can support the projecting portion of the book block.

However, in producing the notches, the projecting portion of the book block must have a width which corresponds at least to the depth of the notches. When the known pressing rollers are used, the unstable guidance provided by these rollers leads to inaccuracies and damage to the back of the book block.

SUMMARY OF THE INVENTION

Therefore, it is the primary object of the present invention to provide an apparatus of the above-described type which is capable of processing the back of a book block in such a way that the sheets passing the abutment are not damaged and wear of the abutment is essentially prevented, without resulting in a reduction of the quality of the book block.

In accordance with the present invention, the abutment acting on the projecting portion of the book block includes a rotatable cylindrical support surface. A guide member for the abutment is arranged rearwardly offset relative to the cylindrical support surface. The guide member has a groove which surrounds the travel path of the cutting tool. The cylindrical support surface is arranged above the groove of the guide member.

The known rotating notch cutting tools are suitable for use in this apparatus.

When using a notch cutting tool which is rotatingly driven in a plane extending parallel to the back of the book block, or when using a plain or face milling cutter, the grooves in the guide member extend approximately parallel to the mounted back of the book block. On the other hand, when using a rotating notch cutting tool, the groove additionally has the shape of a circular arc.

In accordance with a useful feature, the abutment is constructed so as to be freely rotatable. However, the abutment may also be driven with the same speed as the book blocks.

In order to increase the reliability and accuracy during the cutting of notches by means of a cutting tool travelling on a circular travel path extending parallel to the back of the mounted book block, a preferred feature of the present invention provides that the travel path is a groove in a guide plate arranged rearwardly offset relative to the cylindrical support surface.

To be able to produce a relatively high pressure on the book block in the vicinity of the back thereof, another advantageous feature provides that the cylindrical support surface is part of a projecting disk of a body of rotation mounted approximately perpendicularly relative to the processing plane.

For achieving a small distance between the cylindrical support surface and the cutting plane of the notch cutting tool, another advantageous feature provides that the rim of the end face of the abutment is constructed so as to slide on the guide plate, and a small distance from the groove bottom may be provided.

Since the guide plate, when constructed as a single piece, is relatively thin because of the notch cutting tool extending into the groove and, therefore, is not particularly suitable for a load application by the abutment, it is advantageous if the abutment is mounted on a bearing shaft which is unilaterally fastened in a support member.

In order to adjust the abutment relative to the projecting portion of the book block, the abutment is preferably constructed so as to be adjustable.

For maintaining an optimum accuracy to size, the bearing shaft is axially guided in the guide plate on the end located opposite the fastening end.

The support member fastening the bearing shaft is connected to the guide plate in order to form a simple and stable element.

The guide plate may be composed of several parts, so that portions of the guide plate which are subject to wear can be replaced.

For this purpose, the guide plate preferably is composed of a main plate and two base parts which are releasably connected to the main plate and can easily be replaced.

The base parts preferably form the end of the guide plate facing the projecting portion of the book block.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described a preferred embodiment of the invention.

DETAILED DESCRIPTION OF THE PREFERRED EMBODIMENT

Figure 1:
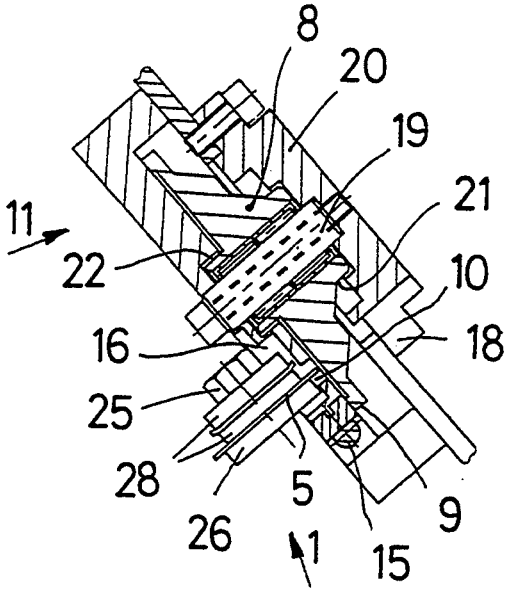
FIG. 1 is a cross-sectional view of the apparatus according to the present invention, taken along sectional line I—I of FIG. 2.
Figure 2:
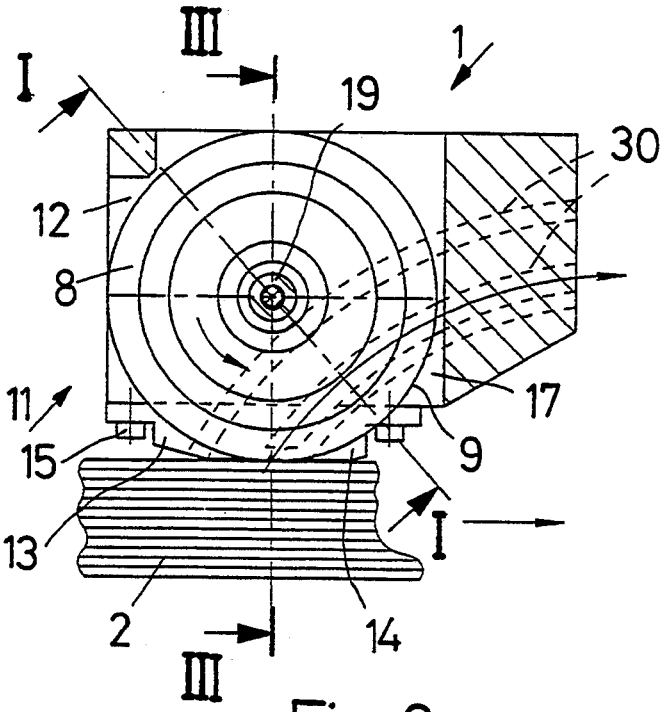
FIG. 2 is a top view taken along line II—II of FIG. 3.
Figure 3:
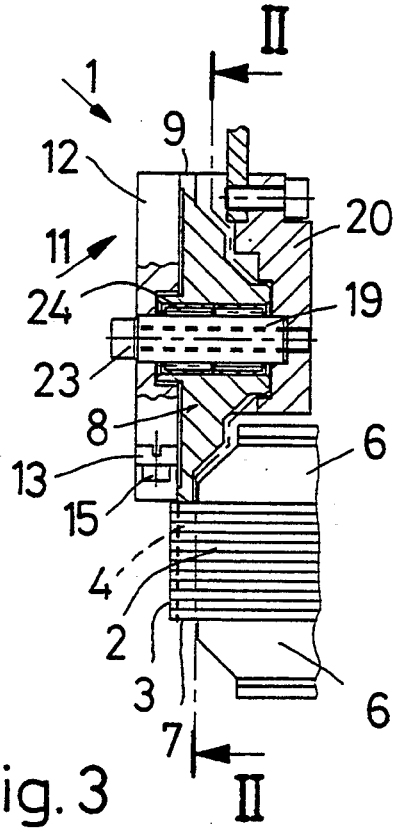
FIG. 3 is a cross-sectional view taken along sectional line III—III of FIG. 2.

FIGS. 1 to 3 of the drawing show an apparatus 1 for a book binding machine for producing books or brochures which are glued at the backs. The book blocks 2 have at the backs 3 thereof notches 4 which extend approximately transversely to the side edges or folded edges. The notches 4 are preferably produced by rotating chip-producing cutting tools or milling cutters 5.

For cutting the notches 4, a book block 2 is mounted in the two-part clamping device 6 and the portion 7 of the book block 2 projecting at the bottom side of the clamping device 6 rests laterally against an abutment 8 which supports the projecting portion 7 against the cutting force of the cutting tool 5 and prevents the sheet edges from spreading apart.

The abutment 8 acting on the projecting portion 7 is provided with a rotatable cylindrical support surface 9 which is driven by frictional engagement with the projecting portion 7. However, it also possible to drive the abutment 8, so that the cylindrical support surface 9 has the same speed as the book blocks 2. The drivable abutment 8 is arranged above a groove 10 which laterally surrounds the travel path of the notch cutting tool 5, wherein the groove 10 is arranged in a guide plate 11 which is rearwardly offset relative to the book block from the cylindrical support surface 9. As illustrated in the drawing, the guide plate 11 may be composed of several parts 12, 13 and 14.

If the guide plate is constructed as one piece, the projecting portion 7 must be greater in order to be able to obtain the desired notch depth. In addition, a lateral reinforcement of the guide plate 11 is required.

However, in the illustrated embodiment, the guide plate 11 includes a main plate 12 and base parts 13 and 14 connected to the main plate 12, wherein the base parts 13 and 14 are placed on the main plate 12 and are fastened thereto by means of screws 15. Because of a recess 16 along the travel path of the notch cutting tool 5, the main plate 12 is composed of two parts. This requires that the main plate part 17 is fastened on a stationary adapter 18 which is connected to the stand of the book binding machine.

The adapter 18 may be mounted, for example, on the support member 20 which receives the bearing shaft 19 of the abutment 8. The support member 20, in turn, is connected to the machine stand.

If a cutting tool 5 is used which rotates parallel to the back 3 of the book block 2, as shown in FIGS. 1 and 2, recess 16 for the travel path of the rotating cutting tool 5 extends along a circular arc according to broken lines 30 in FIG. 2. The axis of the travel path of the cutting tool 5 is fixedly arranged approximately perpendicularly relative to the back 3 of the book block 2.

The recess 16 is one of the reasons why the guide plate 11 is composed of several parts.

If plain or face milling cutters are used which are moved from below against the back of the book block, it is advantageous if the milling cutters are driven at the same speed as the travel speed of the book block. In other words, the milling cutters are driven so as to travel with the book block during the cutting procedure and so as to be returnable into the initial position.

The rotating abutment 8 has a pyramid-like stepped circular cross-section and is at its circumference provided with the cylindrical or disk-shaped support surface 9. The two end faces of the abutment 8 are provided with neck-like attachments 21, 22 which engage in corresponding recesses and form a labyrinth-type seal against dust and chips.

An annular sliding surface which rests against the guide plate 11 is provided at the periphery of the end face of the abutment 8 facing the guide plate 11. A screw 23 is fixedly mounted on the support member 20. The screw 23 extends axially through the bearing shaft 19 and secures one end of the bearing shaft 19 which extends perpendicularly to the back 3 of the book block 2. The other end of the bearing shaft 19 is guided in an opening of the guide plate 11. Two needle bearings 24 are provided for supporting the abutment 8.

FIG. 1 of the drawing shows a chucking device for the cutting tool. The chucking device includes a screw 25 which clamps the cutting tool 5 against a holder 26, and washers 28. The cutting tool 5 may be a disk provided at the circumference thereof with cutting teeth, wherein the disk is turned after the cutting efficiency diminishes. Other similar chip-removing tools may also be used.

It should be understood that the preferred embodiments and examples described are for illustrative purposes only and are not to be construed as limiting the scope of the present invention which is properly delineated only in the appended claims.

We claim:

1. An apparatus in a bookbinding machine for producing in a back of a book block notches which extend essentially transversely of the back of the book block, the apparatus comprising means for mounting the book block such that a portion of the book block projects from the means, a notch cutting tool mounted as to be moveable along a travel path for cutting notches in the projecting portion of the book block, a rotatably mounted abutment having a cylindrical support surface for laterally supporting the projecting portion against a cutting force exerted by the notch cutting tool, a guide means mounted rearwardly offset from the cylindrical support surface of the abutment, the guide means defining a groove surrounding the travel path of the notch cutting tool, wherein the cylindrical support surface of the abutment is located opposite the groove of the guide means.

2. The apparatus according to claim 1, wherein the notch cutting tool is moveable about an axis extending perpendicularly to the back of the book block, and wherein the groove of the guide means extends along a circular arc.

3. The apparatus according to claim 1, wherein the notch cutting tool is moveable in a cutting plane, the abutment being a body of rotation mounted so as to be rotatable approximately perpendicularly to the cutting plane, and wherein the body of rotation comprises a projecting disk, the cylindrical support surface being formed on the disk.

4. The apparatus accordingly to claim 3, wherein the abutment has a rim facing the guide means, wherein the guide means is a guide plate, the rim being configured so as to slide on the guide plate.

5. The apparatus according to claim 3, further comprising a support member and a bearing shaft having first and second ends, the first end of the bearing shaft being fastened to the support member, the abutment being mounted on the bearing shaft.

6. The apparatus according to claim 5, wherein the second end of the bearing shaft is axially guided in the guide means.

7. The apparatus according to claim 5, wherein the support member is connected to the guide means.

8. The apparatus according to claim 2, wherein the guide means is a guide plate comprising a plurality of components.

9. The apparatus according to claim 8, wherein the components of the guide plate are a main plate and two base parts releasably connected to the main plate, and wherein the base parts include the travel path of the notch cutting tool.

10. The apparatus according to claim 9, wherein the base parts form an end of the guide plate facing the projecting portion of the book block.

* * * * *

UNITED STATES PATENT AND TRADEMARK OFFICE

CERTIFICATE OF CORRECTION

PATENT NO. : 5,383,755

DATED : January 24, 1995

INVENTOR(S) : Fredy Hässig and Marcel Stolz

It is certified that error appears in the above-indentified patent and that said Letters Patent is hereby corrected as shown below:

On the title page item [54], column 1, lines 1-4, should read

APPARATUS IN A BOOK BINDING
-- MACHINE FOR PRODUCING NOTCHES IN --
THE BACK OF A BOOK BLOCK

Signed and Sealed this

Fourth Day of April, 1995

*Attest:*

Bruce Lehman

BRUCE LEHMAN

*Attesting Officer*

*Commissioner of Patents and Trademarks*